United States Patent [19]

Dwyer, Jr. et al.

[11] 4,413,641

[45] Nov. 8, 1983

[54] CIGARETTE MOUTHPIECE

[75] Inventors: R. William Dwyer, Jr.; Mable L. Fleming, both of Richmond, Va.

[73] Assignee: Philip Morris Incorporated, New York, N.Y.

[21] Appl. No.: 285,842

[22] Filed: Jul. 22, 1981

Related U.S. Application Data

[63] Continuation-in-part of Ser. No. 73,394, Sep. 7, 1979, abandoned.

[51] Int. Cl.[3] ..... A24D 3/00

[52] U.S. Cl. ..... 131/361; 131/330

[58] Field of Search ..... 131/339, 331, 338, 187, 131/361

[56] References Cited

U.S. PATENT DOCUMENTS

| | | |
|---|---|---|
| 1,945,207 | 1/1934 | Thomas . |
| 2,954,784 | 10/1960 | Lerert . |
| 3,062,219 | 11/1962 | Miller . |
| 3,394,713 | 7/1968 | Thomson et al. . |
| 3,460,544 | 8/1969 | Doppelt . |
| 3,504,677 | 4/1970 | Doppelt . |
| 3,604,428 | 9/1971 | Moukaddem . |
| 3,685,523 | 8/1972 | Labbe . |
| 3,768,489 | 10/1973 | Keiffer et al. . |
| 3,789,855 | 2/2974 | Norman . |
| 3,840,029 | 10/1974 | Strevle et al. . |
| 3,860,011 | 1/1975 | Norman . |
| 3,939,848 | 2/1976 | LeRoy . |
| 4,016,887 | 4/1977 | Uroshevich . |

FOREIGN PATENT DOCUMENTS

| | | |
|---|---|---|
| 1110070 | 2/1958 | Fed. Rep. of Germany . |
| 1975669 | 12/1967 | Fed. Rep. of Germany . |

*Primary Examiner*—Stephen C. Pellegrino
*Attorney, Agent, or Firm*—Robert M. Shaw

[57] ABSTRACT

A mouthpiece for a filter-tipped smoking product or a filtered cigarette holder which has an inlet end adjacent the mouth end of the filter and an outlet end opposite the inlet end through which smoke may leave the cigarette or cigarette holder for passage into the mouth of the smoker. The outlet end has at least one orifice therein and the orifice is of smaller area in transverse section than the filter. The inlet end is of substantially the same transverse area as the filter and is connected to the orifice by a continuous channel which continuously decreases in transverse sectional area from the inlet end to a point between the inlet end and the outlet end and from which point to the orifice is either the same or continuously increasing until it is the same transverse sectional area as the orifice. Smoke exiting the filter passes into the channel at the inlet end of the mouthpiece, passes exclusively through the channel and exits through the orifice in a narrow pattern.

8 Claims, 6 Drawing Figures

CIGARETTE MOUTHPIECE

This is a continuation-in-part of application Ser. No. 73,394, filed Sept. 7, 1979, now abandoned.

BACKGROUND OF THE INVENTION

The present invention relates to a means for enhancement of the impact, smoke flavor and satisfaction experienced by smokers. More particularly, the present invention relates to a mouthpiece or exit tip baffle for filtered cigarettes or filtered cigarette holders which enhances the subjective effect of the smoke.

As the trend toward cigarettes of lower delivery, that is, cigarettes which deliver less "tar", nicotine or the like continues, some smokers have complained of too little impact, smoke flavor or satisfaction. One solution is to add more flavor to the tobacco than is conventionally added. It has been discovered, however, that the subjective effect of the smoke may be enhanced without the addition of increased amounts of flavor by employing the mouthpiece of the present invention.

Heretofore, numerous mouthpieces, or holders, have been employed with smoking products such as cigarettes, and a number of these have provided for a localized exit orifice or orifices for the smoke. The orifices have been located centrally, at the periphery, or at locations therebetween in the outlet end of the mouthpiece or holder, but the location has generally be dictated by the filtering, or cooling function, of the mouthpiece, or some such similar function.

U.S. Pat. No. 1,945,207 discloses a mouthpiece for non-filtered cigarettes, which is preferably constructed of wood and has a longitudinal smoke passage therein. The end of the smoke passage abutting the tobacco is of substantially less area in transverse section than the tobacco portion of the cigarette. The passage tapers toward a point intermediate the ends of the mouthpiece and then continues as a relatively narrow passage which connects with an orifice in the other end of the mouthpiece.

U.S. Pat. No. 3,789,855 discloses a mouthpiece for an unfiltered cigarette having vertilating perforations therein which are open to the atmosphere and which are provided to deliver vertilating air directly into the mouth of the smoker separately from the smoke stream. The smoke stream passes through a passage which, at the end abutting the tobacco, is a cylinder having a diameter substantially equal to the diameter of the tobacco section of the cigarette. The passage at the other, or outlet, end of the mouthpiece is also cylindrical but has a reduced diameter and has an opening for communicating with the mouth of the smoker. The passage between the two cylinders decreases smoothly and continuously from the diameter of the first cylindrical portion to the diameter of the second cylindrical portion. In an alternative embodiment, the smaller cylinder is dispensed with and the larger cylinder decreases in diameter until it joins and is the same diameter as an orifice in the outlet end of the mouthpiece.

U.S. Pat. No. 3,604,428 discloses a combined tar-and-nicotine removal device which is adapted to receive one end of a cigarette. Contained within the device is a first filter adjacent the end of the inserted cigarette, and adjacent the opposite end of the filter is a tar removal device. The tar removal device is an annular ring or cylinder having a diameter less than the diameter of the filter, and which cylinder decreases in diameter until it is the same diameter as a second cylinder, which is a central passageway connecting with a crosscut chamber that connects with an arcuate passageway which, in turn, connects through a porous plug with a second filter. After the smoke from the cigarette has passed through the first filter, the first cylinder, the second cylinder, the crosscut passage, the arcuate passage, the porous plug and then the second filter, it reaches the smoker's mouth.

Various other such mouthpieces, holders and filters, which are believed to be less relevant to the present invention than those disclosed in the aforementioned patents, are disclosed in U.S. Pat. Nos. 3,062,219; 3,394,713; 3,460,544; 3,504,677; 3,685,523; 3,768,489; 3,840,029 and 3,939,848.

SUMMARY OF THE INVENTION

The present invention is a mouthpiece or exit tip baffle which is attached at one end either to the mouth end of a filter of a filter-tipped smoking product, such as a filter-tipped cigarette, or to the mouth end of the filter of a filtered cigarette holder. The smoke exiting the filter passes exclusively through the mouthpiece which serves to focus or collimate the smoke into a narrow pattern. The mouthpiece has an inlet end adjacent the filter and an outlet end opposite said inlet end and having at least one orifice therein. The orifice is of smaller area in transverse section than the filter and a continuous channel connects the inlet end to the orifice. The channel is of substantially the same area in transverse section at the inlet end as the filter and is of the same area in transverse section at the outlet end as the orifice. In between the inlet end and a point located between the inlet end and the orifice the transverse sectional area of the passage continuously decreases and then from that point to the orifice is either the same or continuously increases until it is the same transverse sectional area as the orifice. Smoke passes through the filter and then into the inlet end of the mouthpiece, wherein it is focused such that it exits at the outlet end through the orifice in a preselected narrow pattern. It has been found that the mouthpiece of the present invention improves the subjective perception of cigarettes which have a low "tar" delivery and enhances the subjective effect of the smoke exiting the filter of a filter-tipped smoking product, which may have been attenuated by dilution or filtration.

DESCRIPTION OF THE INVENTION

The invention will now be described with reference to the drawings in which a number of representative embodiments of the present invention, some of which are particularly preferred, are disclosed.

Figure 1:
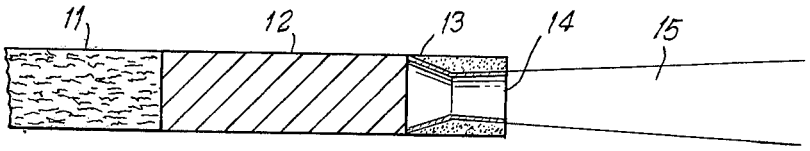
FIG. 1 is a longitudinal section of the mouth end of a filter-tipped cigarette provided with a mouthpiece of the present invention.

In FIG. 1, the smoke from cigarette rod 11 passes through a filter 12 and is collimated by mouthpiece 13, which may be of plastic or the like and which is non-porous, to exit through orifice 14, diameter 0.44 cm, in a stream which is shown schematically as 15 based on observations made using high speed cinematography during smoking by an automated smoking machine.

Figure 2:
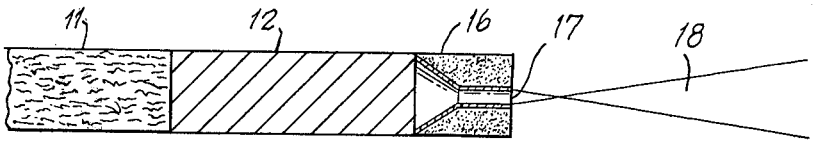
FIG. 2 is a longitudinal section of the mouth end of a filter-tipped cigarette provided with an alternative embodiment of the mouthpiece of the present invention.

In FIG. 2, mouthpiece 16, having an orifice 17, 0.16 cm in diameter, produces a smoke pattern 18 which converges to a focus and diverges thereafter.

Figure 3:
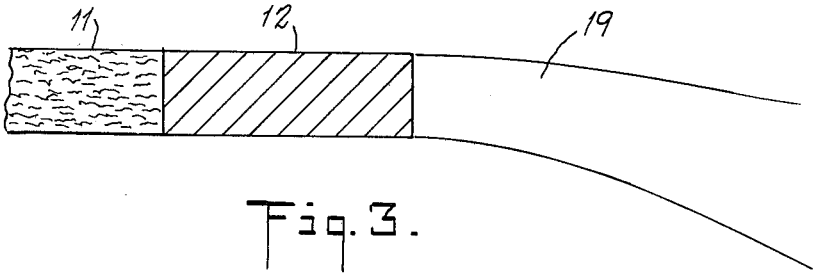
FIG. 3 is a longitudinal section of the mouth end of a filter-tipped cigarette that has not been provided with a mouthpiece.
Figure 4:
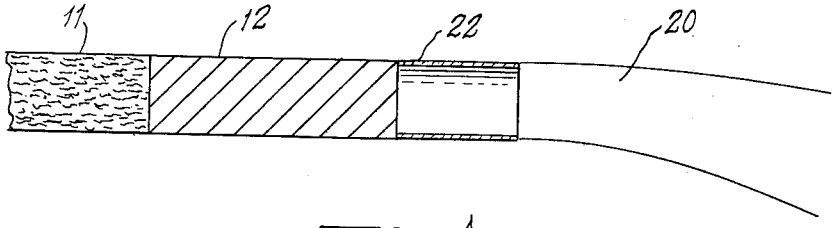
FIG. 4 is a longitudinal section of the mouth end of a type of filter cigarette commonly known as a recessed filter cigarette.

In contrast, FIG. 3 illustrates the exit pattern 19 diverging directly from a filter-tipped cigarette having a conventional 0.78 cm diameter and which has not been provided with a mouthpiece. In FIG. 4, the pattern 20 from the prior art recessed filter cigarette is kept nearly constant by hollow cylindrical mouthpiece 22.

Figure 5:
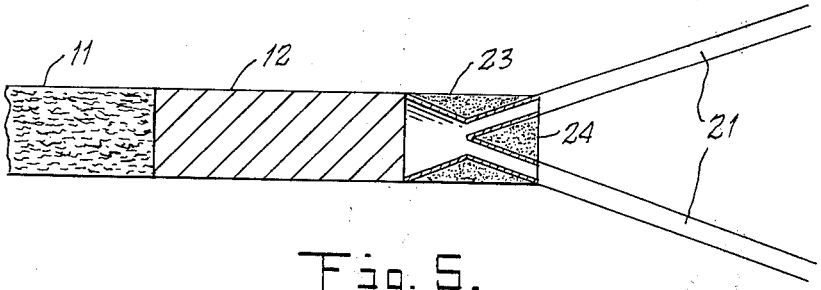
FIG. 5 is a longitudinal section of the mouth end of a filter-tipped cigarette provided with yet another embodiment of the mouthpiece of the present invention.

In FIG. 5, a filter cigarette equipped with mouthpiece 23 having cone-shaped baffle portion 24 (supported in its central location by fins or prongs not shown) gives an exit smoke pattern 21 which is cone-shaped. The mouthpiece has an annular orifice in the outlet end, and a channel which from the annular orifice to a point between the orifice and the inlet end is a substantially cone-shaped passage defined by the cone-shaped baffle 24 having its apex at said point, and which from said point to the inlet end is a cone-shaped space, also having its apex at said point, thus providing a continuous channel between the annular orifice and the inlet end.

Figure 6:
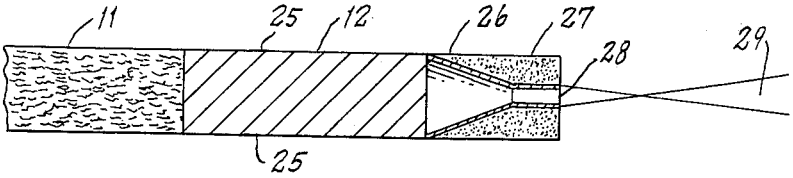
FIG. 6 is a longitudinal section of the mouth end of a filter-tipped cigarette provided with still another embodiment of the mouthpiece of the present invention.

In FIG. 6, a mouthpiece 27 having a cone-shaped space 26, and an exit orifice 28 gives an exit smoke pattern 29, which converges to a focus and diverges thereafter. The mouthpiece is attached in abutting relationship to a filter 12, which is provided with a plurality of perforations 25, which serve to admit air when the smoker draws on the cigarette and which mixes with the smoke in the filter as it passes therethrough.

Thus, the present invention is a mouthpiece for a filtered smoking product, such as a filter-tipped cigarette, or filtered cigarette holder comprising an inlet end and an outlet end opposite said inlet end, said outlet end having at least one orifice therein through which the smoke exits the cigarette and being of smaller area in transverse section than the filter in the cigarette or cigarette holder, a continuous channel connecting the inlet end and the orifice, said channel being of the same area in transverse section at the outlet end as the orifice, being of substantially the same area in transverse section at the inlet end as the filter, said channel continuously decreasing in transverse sectional area from said inlet end to a point between the inlet end and the orifice, and being, from that point to the orifice, the same or continuously increasing to the same transverse sectional area as the orifice. Smoke enters the mouthpiece at the inlet end after passing through the filter and is focused or collimated by passage through the channel and orifice.

The present invention is also directed to a filter-tipped cigarette in which the inlet end of the mouthpiece abuts the mouth end of the filter and is substantially equal in transverse sectional area thereto. Preferably, the mouthpiece is cylindrical and has a diameter which is the same, or substantially the same, as the diameter of the filter and is attached thereto in abutting relationship between the mouth end of the filter and the inlet end of the mouthpiece.

The embodiments disclosed in FIGS. 1, 2, 5 and 6 are preferred, with the embodiments shown in FIGS. 2 and 6 being more preferred, and the embodiment shown in FIG. 2 being particularly preferred.

The channel at the inlet end, regardless of the embodiment, will be of substantially the same transverse sectional area as the filter which it abuts and is preferably of the same transverse sectional area as the filter. The channel continuously decreases in transverse sectional area from the inlet end to a point between the inlet end and the outlet end. This point may be approximately midway between the inlet and outlet ends, or may be proximate either the inlet end or the outlet end, that is, between the midpoint of the channel and either the outlet end or the inlet end. The channel may thus be cone-shaped or funnel-shaped between the inlet end and this point. The channel is continuous and is not occluded at any point. From the point at which the channel ceases to continuously decrease in transverse sectional area from its maximum area at the inlet end, the channel either is of substantially the same transverse sectional area as the orifice, as in FIGS. 2 and 6, or continuously increases in transverse sectional area from said point to the orifice until it is of the same transverse sectional area as the orifice, as in FIG. 1.

The orifice in the outlet end may be located on the longitudinal axis of the mouthpiece, at the periphery of the outlet end or between the periphery and the longitudinal axis. Preferably, the orifice is located on the longitudinal axis of the mouthpiece. There is at least one orifice and, thus, there may be a plurality of orifices in the outlet end of substantially the same or of varying transverse sectional area and which may be located at the periphery, about the longitudinal axis or in any random or symmetrical pattern. Regardless of placement and number, the transverse sectional area of each individual orifice is less than the transverse sectional area of the filter, preferably substantially less, and where there is more than one orifice the channel connects with each orifice as a plurality of passageways, each of which converges at, or substantially at, the point at which the transverse sectional area of the channel ceases to decrease from its maximum area at the inlet end. The orifice is preferably an annular opening and a circular opening on or about the longitudinal axis of the mouthpiece is particularly preferred.

The present invention also includes filter-tipped cigarettes, of which the one shown in FIG. 6 is exemplary, in which the filter is connected in end-to-end abutting relationship to a mouthpiece of the present invention and in which the filter has a plurality of perforations therein which are open to the atmosphere and permit the passage of air into the filter.

Comparative tests conducted by smokers have shown that the smoke pattern from a low-delivery filter-tipped cigarette, which results from attaching the mouthpiece of the invention, is more acceptable than is the pattern from the same cigarette terminating in a conventional filter. Apparently, the concentration of the attenuated smoke according to the present invention into a narrow stream results in the perception by the smoker of greater impact than would otherwise be the case.

Subjective ratings of the smoke from filter-tipped cigarettes of varying delivery levels were made by expert smokers. These sample cigarettes ranged from about 16 to about 2 mg of "tar" delivery. Each was smoked unmodified (see FIG. 3) and also with the mouthpiece attachment of FIG. 1, which was 8 mm long with a 4 mm constriction length, 0.44 cm diameter orifice, and with the attachment of FIG. 5, which was also 8 mm long. The panel of smokers found that for the lowest delivery samples (2 and 5 mg), they preferred the configuration of FIG. 1. The mouthpiece of FIG. 5, when attached to filter cigarettes and smoked by an expert panel in comparison with comparable cigarettes without mouthpieces, were said to have less burnt flavor when the cigarettes were "conventional" (of relatively high delivery) and to have less green flavor with 5 mg delivery cigarettes.

The invention has been described with reference to the embodiments disclosed in the drawings but these embodiments are merely preferred. Other embodiments which will be apparent to those skilled in the art after reading the foregoing description of the present invention are also included within the scope of the present invention.

We claim:

1. A filter-tipped cigarette having a cylindrical mouthpiece, said mouthpiece comprising an inlet end attached to the exit end of the filter, an outlet end opposite said inlet end from which smoke may leave the cigarette by way of at least one orifice therein, said orifice being an annular opening of smaller area in transverse section than the filter and being centered on the longitudinal axis of the filter, and at least one channel connecting said inlet end of the mouthpiece to said orifice, said channel being non-occluded, being of the same area at the inlet end as the filter, and being of the same area at the outlet end as the orifice, said channel continuously decreasing in transverse sectional area from the inlet end to a point between the inlet end and the outlet end and being from said point to the outlet end a substantially cone-shaped passage defined by a cone-shaped baffle with apex at said point, said filter being cylindrical.

2. The filter-tipped cigarette of claim 1 wherein the channel from the inlet end to said point is a cone having its apex at said point and the channel from said point to the orifice is a cylinder having the same diameter as the orifice.

3. The filter-tipped cigarette of claim 2 wherein said point and said orifice are on the longitudinal axis of said mouthpiece.

4. A filter-tipped cigarette having a cylindrical mouthpiece, said mouthpiece comprising an inlet end abutting the mouth end of the filter, an outlet end opposite said inlet end and having at least one orifice therein, said orifice being of smaller area in transverse section than the filter, and a non-occluded continuous channel connecting said inlet end to said orifice, said channel being of the same area in transverse section at the inlet end as the filter and being of the same area in transverse section at the outlet end as the orifice, said channel continuously decreasing in transverse sectional area from said inlet end to a point between said inlet end and said orifice and, from said point to the orifice, continuously increasing to the same transverse sectional area as the orifice, said filter being cylindrical.

5. The filter-tipped cigarette of claim 1 wherein the orifice is located on the longitudinal axis of the mouthpiece.

6. The filter-tipped cigarette of claim 5 wherein said point is proximate the inlet end.

7. The filter-tipped cigarette of claim 5 wherein said point is approximately midway between the outlet and inlet ends.

8. The filter-tipped cigarette of claim 1 including a plurality of perforations in said filter open to the atmosphere.

* * * * *

UNITED STATES PATENT AND TRADEMARK OFFICE

CERTIFICATE OF CORRECTION

PATENT NO. : 4,413,641

DATED : November 8, 1983

INVENTOR(S) : R. William Dwyer et al

It is certified that error appears in the above—identified patent and that said Letters Patent is hereby corrected as shown below:

Column 6, line 34, change "1" to --4--.

Signed and Sealed this

*Twenty-third* Day of *October 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,413,641

DATED : November 8, 1983

INVENTOR(S) : R. William Dwyer et al

It is certified that error appears in the above-identified patent and that said Letters Patent is hereby corrected as shown below:

Column 6, line 26, Claim 5, change "claim 1" to --claim 4--.

Signed and Sealed this

*Nineteenth* Day of *February 1985*

[SEAL]

*Attest:*

DONALD J. QUIGG

*Attesting Officer* *Acting Commissioner of Patents and Trademarks*